US005154672A

United States Patent [19]

Brown

[11] Patent Number: 5,154,672

[45] Date of Patent: Oct. 13, 1992

[54] SWINGING ARM PIVOTAL SUPPORT MEANS

[75] Inventor: John A. S. Brown, Edwardstown, Australia

[73] Assignee: Hills Industries Limited, Australia

[21] Appl. No.: 597,790

[22] Filed: Oct. 15, 1990

[30] Foreign Application Priority Data

Oct. 27, 1989 [AU] Australia ..... PJ7080

[51] Int. Cl.[5] ..... A47B 96/06; A63G 9/00

[52] U.S. Cl. ..... 472/118; 472/125; 248/370

[58] Field of Search ..... 272/85, 86, 87; 16/250, 16/252, 253, 282; 403/23, 113, 112; 248/230, 370

[56] References Cited

U.S. PATENT DOCUMENTS 3,427,024 2/1969 Cross ..... 272/87
3,503,582 3/1970 Boucher ..... 248/370
4,961,558 10/1990 Cunard ..... 248/370

*Primary Examiner*—Richard E. Chilcot, Jr.
*Attorney, Agent, or Firm*—Baker, Maxham, Jester & Meador

[57] ABSTRACT

An improved bracket support means for pivotally supporting the upper end of a swinging arm used in playground swing equipment, wherein the bracket comprises a pair of spaced apart flanges between which is pivotally supported the upper end of the swinging arm, the upper end of the arm being received in a socket formed in an infill block located between the flanges so that the block and the arm rotate simultaneously, the block being shaped and dimesioned so that there are no gaps or spaces between the flanges into which a child's finger or fingers may enter when the arm is in motion.

9 Claims, 3 Drawing Sheets

SWINGING ARM PIVOTAL SUPPORT MEANS

This invention relates to improved means for pivotally supporting the upper end of a swinging arm of the kind used in playground swing equipment. The invention also relates to an improved pivotal support arm and support bracket combination for use in playground swing equipment.

Numerous bracket designs for pivotally supporting swinging support arms of a play gym are well known to the Applicant and generally make use of an inverted U-shaped metal bracket supported over a cross bar or fixed frame member and having flange portions depending therefrom, the flange portions in turn pivotally supporting one or more pivot pins or bolts on which are swingingly supported one or more depending support arms which are normally formed from a length of straight metal tube. One of the problems associated with such arrangements is that when the support arm is swinging from side to side, it is possible for the fingers (or even hands) of a child (who has hold of the support arms) to be crushed between the underside of the fixed support bracket (or the fixed frame member) and the swinging arm. More severely, with the arms swinging through an extended arc of movement, should any portion of the child's fingers penetrate the space between the opposed flanges of the bracket, a guillotine action between the swinging arm and an edge of one of the flanges, may result in one or more of the fingers being severed.

It is the main object of the present invention to provide an effective and satisfactory arrangement for pivotally suspending a swinging support arm from a support bracket attached to a fixed frame member of a play gym frame, and which is designed so that a clearance between the swinging arm and the fixed support bracket exists throughout the entire arc of movement of the arm whereby the possibility of a child's fingers being crushed between the arm and the fixed bracket whilst the arm is oscillating about its pivot point, is avoided.

It is a further object of the present invention to provide an improved support bracket for pivotally suspending a swinging arm of a play gym which is designed to prevent entry of a child's fingers (or part thereof) into the interior thereof and in turn eliminate any likelihood of the child's fingers being "jammed" or caught therein when the arm is in motion.

According to one aspect of this invention therefore, there is provided improved means for pivotally supporting a pair of spaced apart, aligned swinging support arms each of which has its upper end supported by a horizontal pivot for swinging movement through an arc of rotation and its lower end connected to a child support swing member, wherein each said swinging support arm comprises an elongate lineal portion which terminates at its upper end in a relatively short angled end portion, the angled end portion of each said arm having an inner portion thereof located between a pair of opposed horizontally aligned flanges, which supports a respective said pivot, of bracket means arranged for attachment to a fixed support member, the flanges projecting laterally from opposite sides of the fixed support member, the inner portion of each said support arm, when at rest, extending away from its support pivot in an approximately transverse direction, the arm thereafter extending in a downwards direction, said bracket means having limit means for limiting the maximum arc of rotation for each said arm, constructed and arranged so that a clearance exists between said bracket means and each said arm throughout its entire range of arc movement, which in turn prevents a child's hand(s) or fingers which may be grasping the upper end region(s) of the arm(s) from being crushed between the swinging arm(s) and the bracket means.

Preferably the pivotal support bracket means is designed to permit the swinging arms to swing through an angle of approximately 90° from their at-rest position either in an upwards or downwards direction.

Preferably, the limit means comprise abutment surfaces which form an integral part of the support bracket and which co-operate with surface portions on the angled end portions of the arms to limit the movement of the arms.

Preferably each said bracket means is formed of sheet metal, either as a unitary member or as two identical halves. The opposed flanges of each bracket are part circular and are formed with aligned holes or apertures for receiving a pivot pin or bolt for pivotally supporting a respective said swinging arm.

Preferably the inner end of each said flange terminates in an out-turned flange portion which is provided with one or more holes for receiving securing bolts to releasably secure the support bracket to the fixed support member.

In yet another preferred embodiment of this invention, each bracket half comprises vertically aligned inturned flange portions, the outer edge surfaces of which constitute said abutment surfaces which co-operate with surfaces on the angled end portions of the swing arms to limit the extent of their arc movement in either rotational direction.

In another aspect of this invention, an improved bracket assembly for pivotally supporting an elongate swinging support arm or stay for swinging movement through an arc, comprises;

a bracket securable to a fixed support member, said bracket comprising a pair of opposed spaced apart horizontally aligned flanges arranged to project away from said support member, a pivot pin or bolt extending between and supported by said flanges, said pin or bolt pivotally supporting said swinging arm at or adjacent its upper end and an infill block located between said flanges and having walls defining a socket for receiving an upper end portion of said arm and being rotatable with said arm about said pivot pin or bolt, said block having a peripheral wall dimensioned and shaped so that there are no gaps or spaces between the flanges into which a child's finger(s) may enter when the arm is in motion.

Preferably, the infill block comprises a pair of matching block halves of disc-like shape but of opposite hand, each said half being formed with a central pivot receiving hole and a diametral channel portion extending inwardly from the inner face thereof and opening to one side only of its peripheral wall, arranged so that upon assembly of the halves, a central cavity or socket is formed which is shaped and dimensioned to snugly receive the free end portion of the swinging arm, said pivot pin passing horizontally through one of the flanges, one of the block halves, the end portion of the swinging arm, and in turn through the other block half and the other flange, whereby any swinging movement of the support arm effects simultaneous rotational movement of the block halves.

Preferably, each of the flanges has a part circular peripheral edge which lies approximately flush with the circular peripheral wall of the infill block.

Preferably, the upper end of the swinging arm is bent inwardly, so that the arm, when at rest, initially extends away from its pivot pin in an approximately transverse direction, the arm thereafter extending in a downwards direction.

Preferably, the bracket is provided with limit means for limiting the maximum arc of rotation of said arm.

With this invention therefore, the only injury which a child who may be grasping the upper end of the arm when the arm is in motion, can suffer is a "pinching" of skin between an abutment edge surface on the bracket and an abutment engagement surface on the upper end portion of the arm. No serious injury or damage can occur.

In order to more fully explain the present invention, several embodiments are described hereunder in some further detail with reference to the accompanying drawings, wherein.

Figure 1:
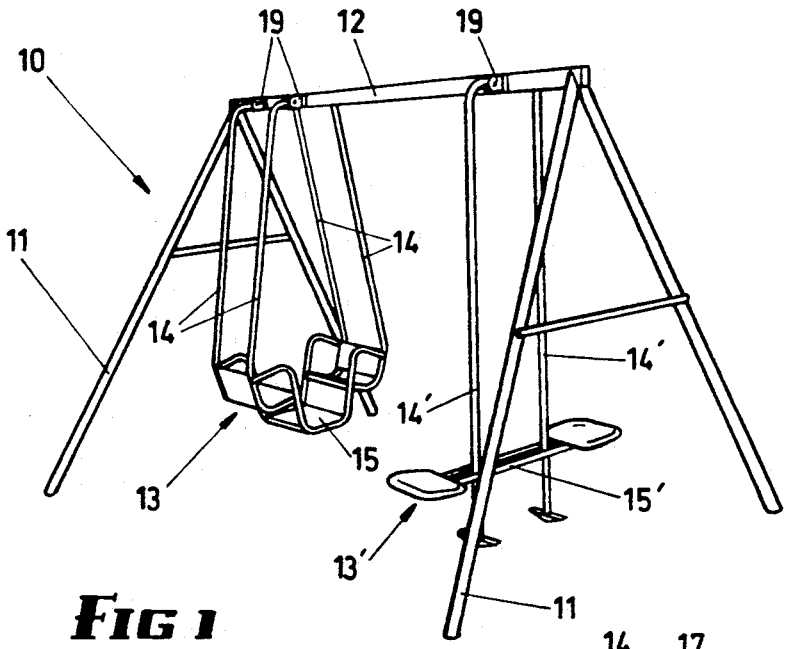
FIG. 1 is a perspective view of play gym equipment having swings (at rest) suspended by swinging arms and pivotal support means according to a first embodiment of this invention.
Figure 2:
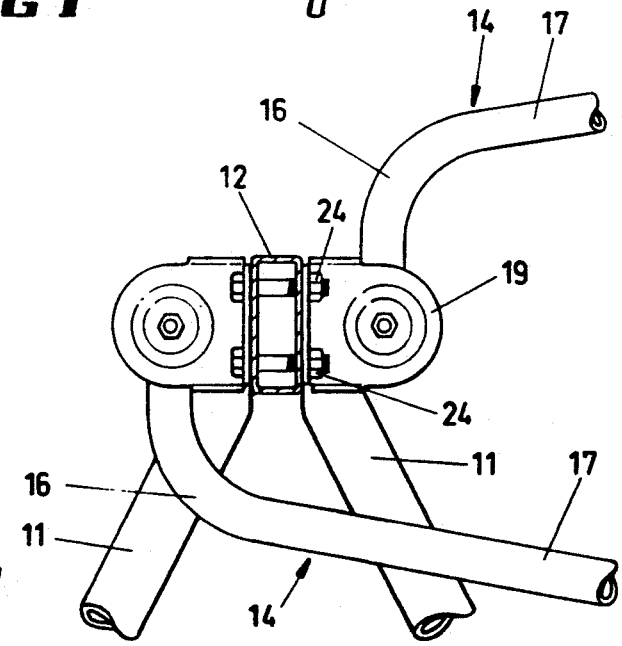
FIG. 2 is a fragmentary end elevational view of one of the swings of FIG. 1 shown in its uppermost position in one rotational direction.
Figure 3:
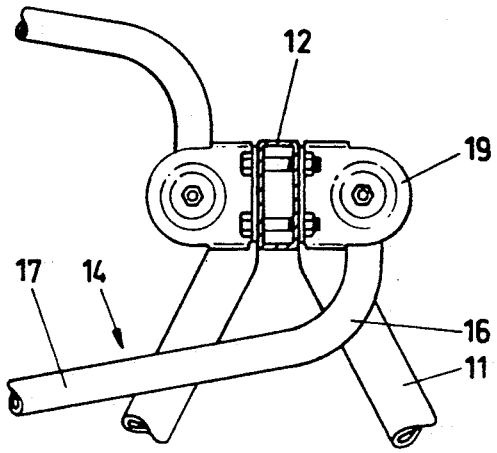
FIG. 3 is a fragmentary end elevational view of the swing of FIG. 2 shown in its uppermost position in the other rotational direction.

In both embodiments, reference is made to playground equipment 10 which comprises a pair of upstanding end frame members 11 between which extends a longitudinally extending fixed upper frame member 12 which supports along its length one or more children's swing devices 13, 13' by means of one or more pairs of transversely aligned depending swinging support arms 14, 14' one on each side of the upper frame member 12. The lower end of each said swinging arm 14 is connected to a respective location on the swing seat member 15, 15' on which a child sits when in use. This is in accord with prior art.

Referring to FIGS. 1 to 4 of the drawings, each swinging support arm or stay 14 is preferably produced from tubular metal and formed with a relatively short bent upper end portion 16, preferably through an angle of approximately 90°, which merges with a straight portion 17 of the arm through a smoothly curved radiused portion. Preferably the upper end portion 16 has a flattened portion 18 formed by a swaging process to assume a rectangular configuration to provide additional strength.

Pairs of transversely aligned matching brackets 19 are attached to the fixed upper frame member 12 for swingingly supporting each of the four (or two) arms 14, 14', each bracket 19 having a pair of horizontally aligned essentially planar parallel flanges 20, projecting laterally from one side of the upper frame member 12. Each flange 20 of the individual brackets 19 terminates at its inner end in an out-turned flange portion 21 which is formed with a series of bolt receiving holes 22, the corresponding flanges 20 of each pair of brackets 19 having their out-turned flange portions 21 facing one another whereby securing bolts 24 can pass through the holes 22 as well as the upper frame member 12 positioned therebetween in order to clamp the brackets 19 to the upper frame member 12.

The flanges 20 of each said pair are provided with centrally located aligned holes 23, for receiving a respective stationary pivot pin or bolt **24*a* (see FIGS. 5 and 6) which also extends through aligned holes 25 in the opposed side walls of the flattened end portion 18 of the swinging arm 14, for pivotally supporting the swinging arm 10 for swinging movement about a horizontal axis 25 which is parallel to and spaced from the longitudinal axis of the upper frame member 12**.

When assembled, each of the swinging arms 14 has its upper end portion extending approximately horizontally away from its pivot point before merging with the depending straight portion 17 of the arm. With this arrangement during the swinging movement of the arms, a gap or clearance always exists between the inner margins of the arms 14 and the underside of the brackets 19. Thus in a situation where a child has his or her hands grasping the upper portions of the swinging arms 14 during operation of the swing the likelihood of fingers being crushed between the bracket(s) 19 or underside of the frame member 12 and the swinging arm 14 is obviated.

Upper and lower limit means are provided on each bracket 19 so as to limit the extent of upward and downward rotational movement of each of the swinging arms 14. In this embodiment the lower limit means for each of the arms 14 is formed by an abutment edge surface 26 of inturned aligned tabs or flange portions 27 on the underside of each of the flanges 20, whilst the upper limit means is formed by abutment edge surfaces 28 formed by similar in-turned aligned tabs or flange portions 29 on the topside of the flanges 19. The abutments 26, 28 are positioned so as to allow each of the arms 14 to undergo swinging movement through approximately 180° range of motion (i.e., 90° in either direction from the at-rest position). At the uppermost or lowermost limit of arc movement, the edge surfaces 26, 28 co-operate with engagement surfaces on the end portions 18 of the arms to inhibit further movement. The position of the surfaces 26, 28 will of course determine the extent of arc movement of the arms.

Figure 4:
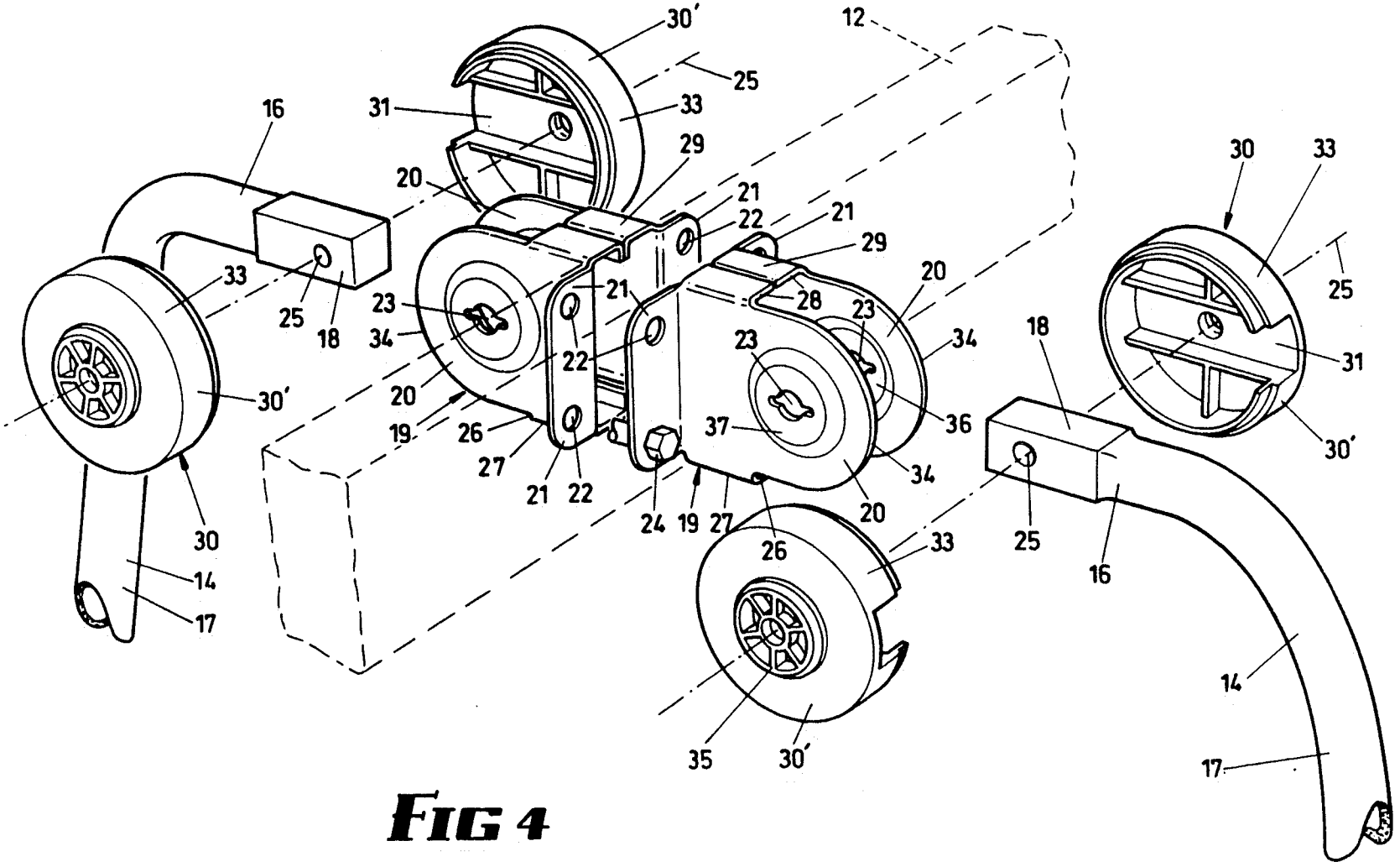
FIG. 4 is a fragmentary, exploded perspective view of one pair of swinging arms and support bracketry, of the equipment shown in FIG. 1.

As shown in FIG. 4, the upper end portion 16 of each of the swinging arms 14 is slidably received in an infill block 30 which is shaped and dimensioned so as to snugly fit between the flanges 20 of each bracket 19 and rotatably supported on the non-rotatable pivot pin or bolt **24*c*, the block 30 being arranged to rotate simultaneously with its associated support arm 14 when the latter is in motion. In this embodiment each end block 30 is formed in two halves, each half 30' being a moulding of polymeric material, and being formed as a circular disc having a diametrically extending slot or recess 31 opening to the inner face of the block half, with the slot or recess 31 being opened at one end and closed at the other. With the two halves 30' assembled together, an approximate rectangular cavity is formed for snugly receiving the flattened end portion 18 of the swinging arm 14**.

The end blocks 30, when inserted between the flanges 20, ensure that there are no gaps or spaces between the flanges 20 into which the fingers of a child may be inserted, as a consequence of which any risk of serious injury is virtually removed. In this embodiment, the peripheral surfaces 33 of the blocks 30 lie approximately flush with the curved edges 34 of the flanges 20 but this is not essential, since the radius of the curved flange portion can be smaller than the radius of the block 30.

Each block half 30' is provided with a control circular bearing portion 35 on its outer face, which engages a circular bearing surface 36 formed on the inner face of each flange 20 by means of a boss portion 37.

Figure 5:
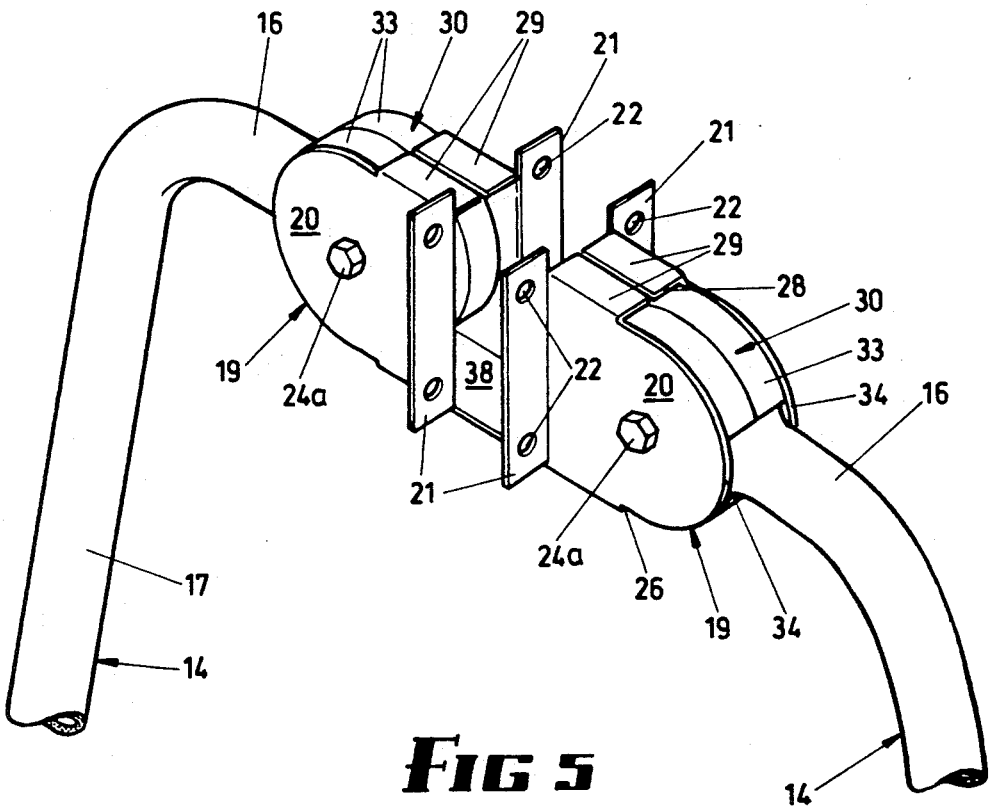
FIG. 5 is a fragmentary, perspective view of a bracket assembly according to a second embodiment.
Figure 6:
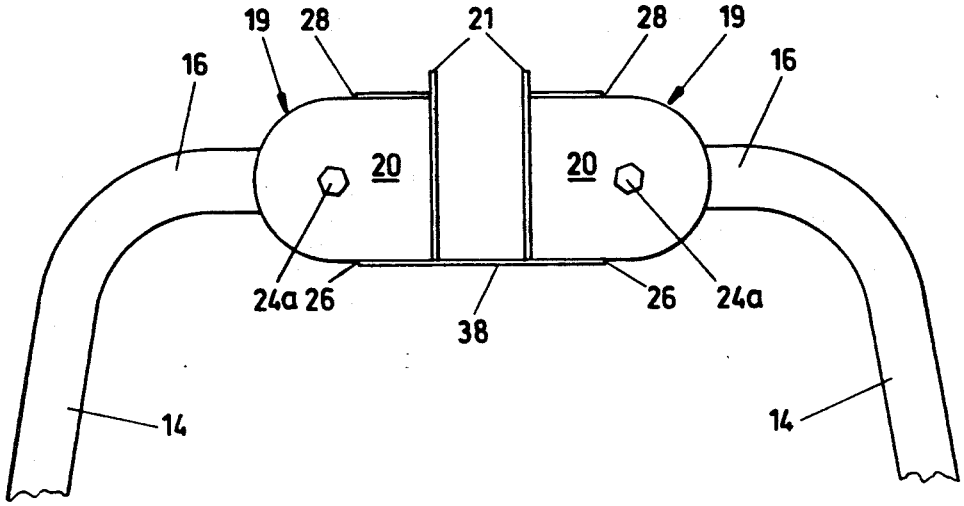
FIG. 6 is a side elevational view of the assembly shown in FIG. 5.

In a variation to the above embodiment, as shown in FIGS. 5 and 6, each pair of brackets 19 (rather than being separate halves) is formed as a unitary member, the brackets 19 being joined together by a web 38 which bears against the underside of the frame member 12 when the brackets are secured thereto. The web 38 also extends between and unites the underside of the pairs of opposed flanges 20.

It should of course be realised that the block 30 may be formed as an integral member rather than in two halves as described above.

It should also be appreciated that the bracket assembly as shown in FIG. 4 of the drawings can be effectively used with support arms which do not have angled upper end portions of the swing member. In this case, the support brackets project downwardly from the underside of the fixed frame member and the arms depend from their brackets with the axis of each arm intersecting the fixed frame member at right angles (when at rest).

It will also be realised that the angle of the bent end portions 16 of the arms can vary widely, depending on the swing unit requirements, and may be 90° (as shown in FIG. for arms 14') or greater than 90° (as shown in FIG. 1 for arms 14) or even less than 90°, as will be realised by a person skilled in the art. To operate effectively, in most applications, the bent upper end should enter the bracket at approximately 90°.

A brief consideration of the above described embodiments will indicate that the invention although very simple, nevertheless results in a vastly improved means for assembling together the swinging support arms of a swing device and their mounting brackets, which virtually eliminates the likelihood of any injury through hands or fingers beings jammed or crushed between the moving and fixed parts of the assembly.

I claim:

1. An improved bracket assembly for pivotally supporting an elongate swinging support arm or stay for swinging movement about an horizontal axis, comprising a bracket securably to a fixed support member, said bracket comprising a pair of opposed spaced apart horizontally aligned flanges arranged to project away from said support member, pivot means extending between and supported y said flanges, said pivot means pivotally supporting said swinging arm at or adjacent its upper end, and an infill member located between said flanges and having walls defining a socket for receiving an upper end portion of said arm and being rotatable with said arm about said pivot means, said member having a peripheral wall dimensioned and shaped so that there are no gaps or spaces between the flanges into which a child's fingers can be inserted when the arm is in motion.

2. A bracket assembly according to claim 1 wherein said infill member comprises a pair of interengaging halves of identical cup-like shape but of opposite hand, each said half having a circular end wall and a peripheral flange extending therearound, said end wall being formed with a central pivot receiving hole and a diametral recess on its inner face, said peripheral flange having an opening therein which communicates with said recess, arranged to that with the halves thus interengaged, a central cavity is formed, which constitutes said socket, and which is shaped and dimensioned to snugly receive the upper end portion of the swinging arm.

3. A bracket assembly according to claim 1 wherein said infill member comprises a pair of interengaging parts, which together form a circular hollow block, the diameter of which is large relative to its axial width.

4. A bracket assembly according to either claim 2 or 3 wherein each of the flanges has an arcuate outer peripheral edge which lies approximately flush with the peripheral wall of said infill member.

5. A bracket assembly according to either claim 1 or claim 2 wherein said swinging support arm comprises an elongate lineal portion which terminates at its upper end in a relatively short angled end portion which contains a through-opening or hole for receiving a pivot pin or bolt of said pivot means.

6. A bracket assembly according to claim 1 wherein said bracket is provided with limit means for limiting the maximum arc of rotation of said arm.

7. A bracket assembly according to claim 6 wherein said limit means comprise abutment edge surfaces on said brackets, each said abutment surface being in contiguous or near contiguous relation with said peripheral wall.

8. A bracket assembly according to claim 7 wherein the abutment surfaces are positioned so that said arm is permitted to swing through an angle of approximately 90° from its at rest position either in a clockwise or anticlockwise direction.

9. A bracket assembly according to claim 1 wherein said bracket is formed by two identical halves.

* * * * *

UNITED STATES PATENT AND TRADEMARK OFFICE

CERTIFICATE OF CORRECTION

PATENT NO. : 5,154,672

DATED : October 13, 1992

INVENTOR(S) : John Arthur Stacy Brown

It is certified that error appears in the above-identified patent and that said Letters Patent is hereby corrected as shown below:

Claim 1, column 5, line 54, change "securably" to --securable--;

column 6, line 3, change "y" to --by--.

Claim 2, column 6, line 22, change "to" to --so--.

Signed and Sealed this

Nineteenth Day of October, 1993

*Attest:*

*Attesting Officer*

BRUCE LEHMAN

*Commissioner of Patents and Trademarks*